US005551194A

United States Patent [19]

Toomey

[11] Patent Number: 5,551,194

[45] Date of Patent: Sep. 3, 1996

[54] ADJUSTABLE HAND RAIL

[76] Inventor: Francis J. Toomey, 27 Burnham Rd., Wenham, Mass. 01984

[21] Appl. No.: 324,791

[22] Filed: Oct. 18, 1994

[51] Int. Cl.[6] ..... E04F 11/18

[52] U.S. Cl. ..... 52/184; 256/65; 256/67

[58] Field of Search ..... 256/59, 67, 60, 256/65, 1; 182/106, 113; D8/363; D25/63, 66, 68; 52/33, 182, 183, 184

[56] References Cited

U.S. PATENT DOCUMENTS

| | | | |
|---|---|---|---|
| 3,161,425 | 12/1964 | Aho et al. | 52/184 |
| 3,269,553 | 8/1966 | Ruhnke | 256/65 |
| 3,286,850 | 11/1966 | Ruhnke | 256/65 |
| 4,220,316 | 9/1980 | Naka et al. | 256/59 |
| 4,383,676 | 5/1983 | Souza, Jr. | 256/59 |

*Primary Examiner*—Michael Safavi

[57] ABSTRACT

An adjustable hand rail wherein a plurality of support posts are arranged for positioning individually between spaced existing rail support members of an existing elongate rail member, wherein the support posts each include a telescoping leg having a resilient pad for frictionally engaging a staircase between the existing rail support posts. The support posts each include a row of slots, with a secondary rail member provided with a plurality of mounting plates, and each mounting plate includes a plurality of projections, wherein the projections of each mounting plate are arranged for reception within a pair of the receiving slots of an individual support post to adjustably position a secondary rail member secured to the mounting plates.

4 Claims, 4 Drawing Sheets

ADJUSTABLE HAND RAIL

TECHNICAL FIELD

The field of invention relates to hand rail structure, and more particularly pertains to a new and improved adjustable hand rail permitting the elongate support rail of the adjustable hand rail organization to be adjusted for adjustable access to a child and the like.

BACKGROUND OF THE INVENTION

The prior art has provided examples of adjustable hand rails as indicated in the U.S. Pat. Nos. 5,056,283; 4,421,302; and 4,939,876.

The prior art has heretofore failed to provide for the use of a retrofit hand rail structure of the type as presented by the instant invention to accommodate a child at various stages of growth to position an associated secondary hand rail member for ease of access to that child.

SUMMARY OF THE INVENTION

The present invention relates to an adjustable hand rail, wherein spaced support posts are secured between existing rail support posts, and wherein each of the support posts extends for securement to an associated existing elongate rail member mounted to the existing rail support post, and wherein a secondary rail member is adjustably securable along the support posts in typically a parallel relationship relative to the existing elongate rail member.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
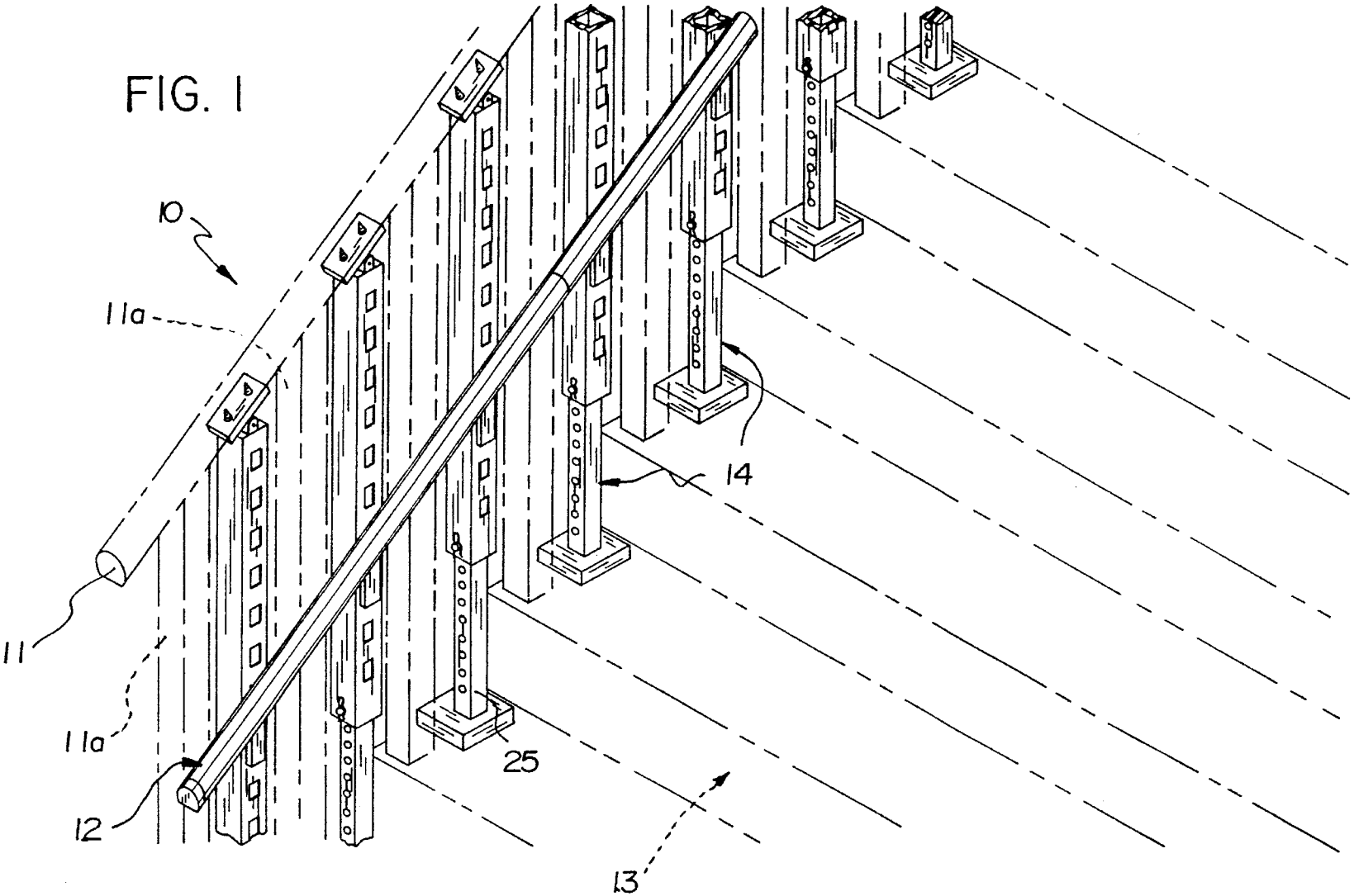
FIG. 1 is an isometric illustration of the invention.
Figure 2:
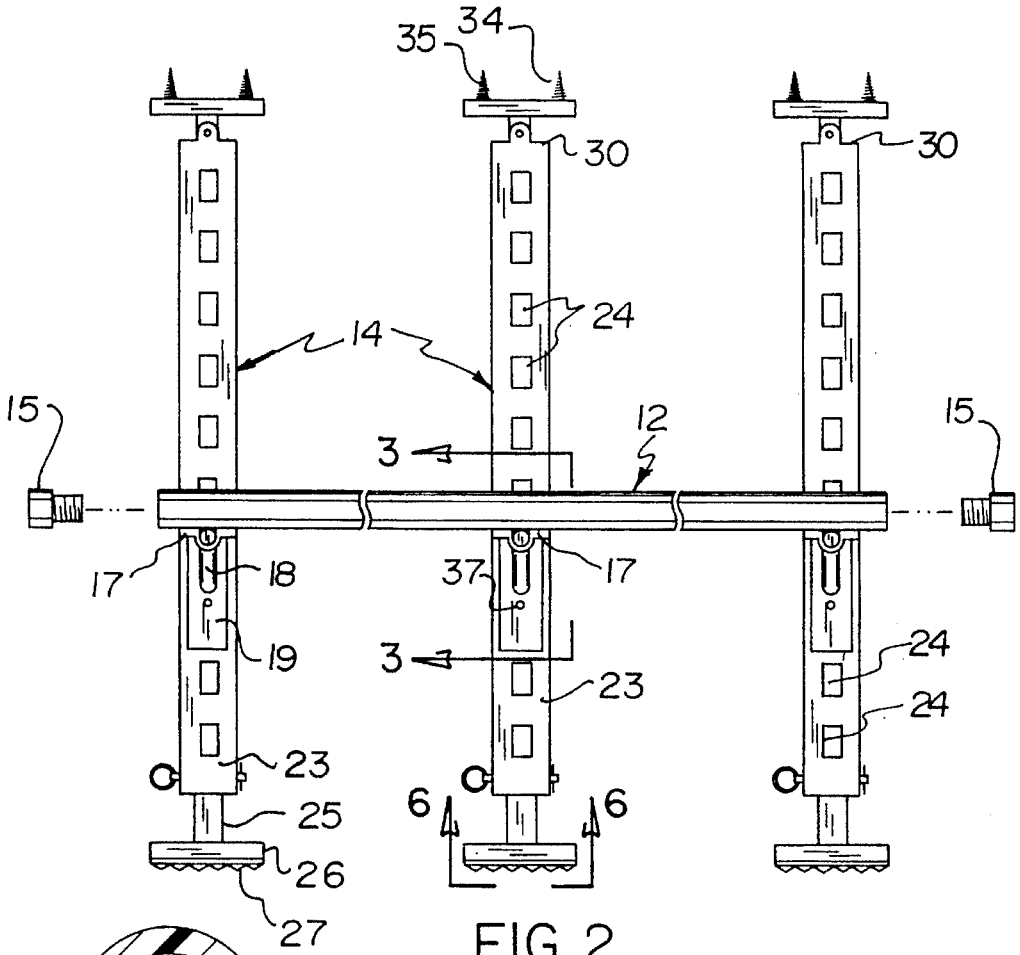
FIG. 2 is an orthographic view taken in elevation indicating the secondary rail member mounted to a plurality of the support posts.

The adjustable hand rail 10 of the invention includes ease of retrofit securement to an existing rail member 11, having existing rail support posts 11*a* extending from the existing rail member 11 to an underlying stair case 13. The invention 10 in this manner employs a secondary hand rail member 12 adjustably secured onto a row of spaced, parallel support posts 14 that are secured at the support post second end to a bottom surface of the existing hand rail member 11 and extend therefrom to the staircase 13 supported by telescoping legs 25. The FIG. 2 notes that the secondary rail member 12 may employ end caps 15 at each distal end of the secondary rail member to permit adjustable sectioning of the secondary rail member 12 in subsequently inserting the end caps 15 therein.

Figure 3:
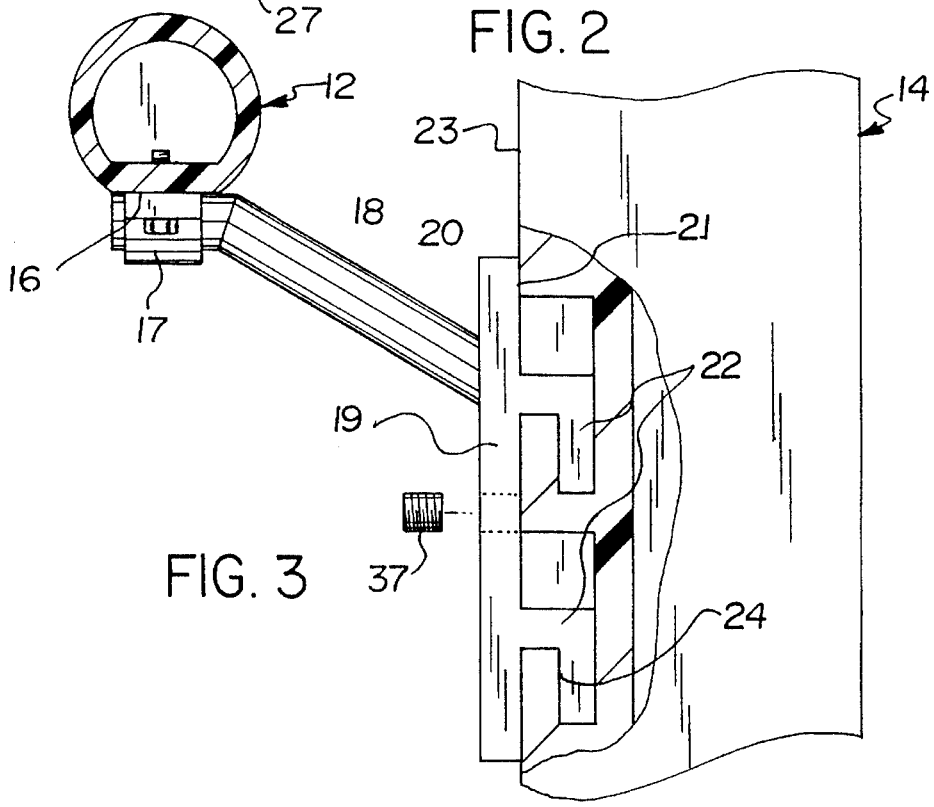
FIG. 3 is an enlarged orthographic view, partially in section, taken along the lines 3—3 of FIG. 2 in the direction indicated by the arrows.

The support post 14 as noted above is arranged to adjustably support the secondary rail member 12, wherein the secondary rail member includes a secondary rail bottom wall 16 having spaced rail brackets 17 spaced apart a predetermined spacing substantially equal to that predetermined spacing between the support post 14. Each of the rail brackets 17 receives the first end of a support leg 18, wherein the second end of the support leg 18 extends fixedly to the front wall 20 of a mounting plate 19. The rear wall 21 of the mounting plate 19 includes a plurality of projections 22 that are typically L-shaped, as illustrated in FIG. 3, and are complementarily received within a like plurality of receiving slots 24 (see FIGS. 2 and 3 for example) of a row of such receiving slots directed through the support post's facing side wall 23, with that side wall arranged in a facing relationship relative to the mounting plate 19. In this manner, with the mounting plate's rear wall 21 in contiguous communication with the facing side wall 23, a lock fastener 37 is directed through the mounting plate 19 into engagement with the facing side wall 23.

Figure 5:
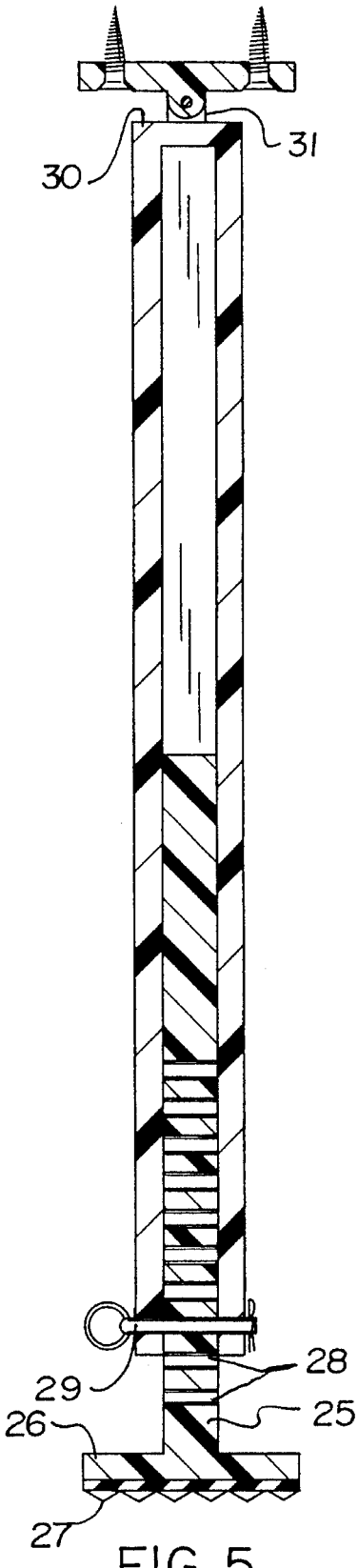
FIG. 5 is an orthographic view, taken along the lines 5—5 of FIG. 4 in the direction indicated by the arrows.
Figure 6:
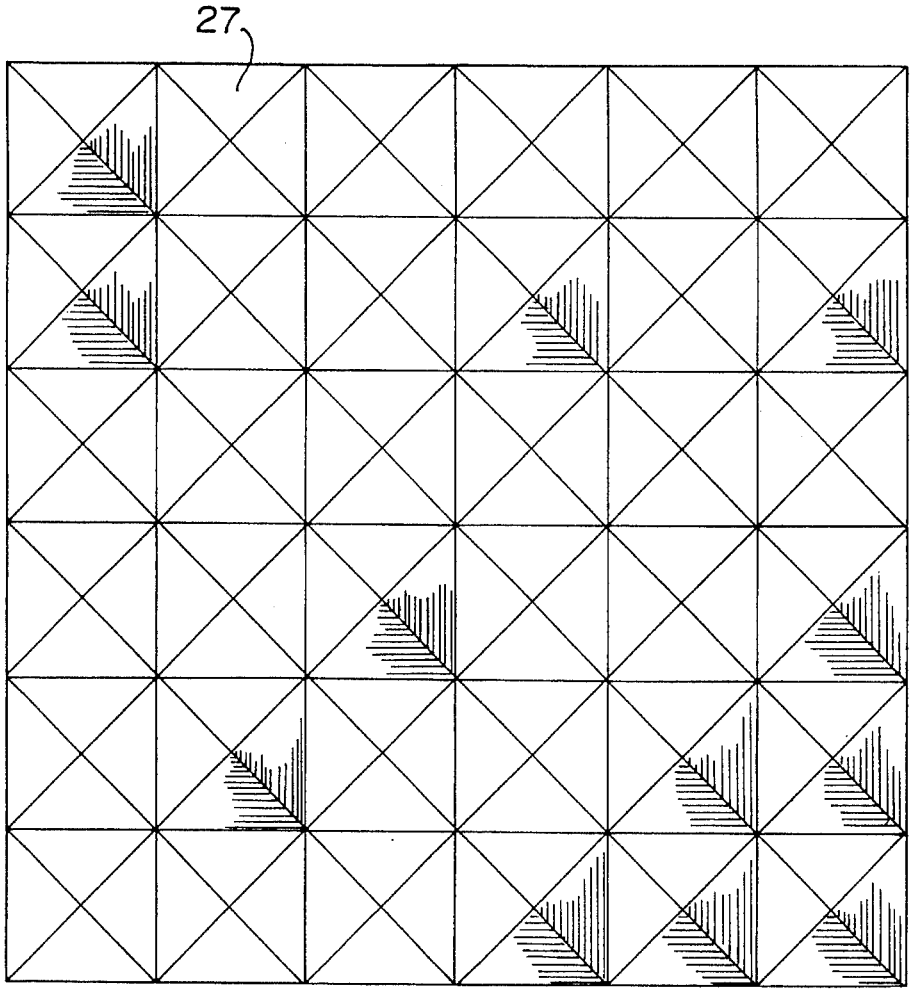
FIG. 6 is an orthographic view, taken along the lines 6—6 of FIG. 2 in the direction indicated by the arrows.

Received through the support post 14 first end is a telescoping leg 25, with the telescoping leg 25 having a support plate 26 fixedly secured to the telescoping leg exteriorly of the support post 14, such that the support plate 26 includes a resilient support pad 27, such as indicated in the FIGS. 5 and 6 for example. A row of leg bores 28 extends through the telescoping leg 25, such that a lock pin 29 is directed through one of those leg bores 28 and simultaneously through the support post 14 to telescopingly position the extent of projection of the telescoping leg 25 relative to the support post 14, such as illustrated in FIG. 5 for example.

Figure 4:
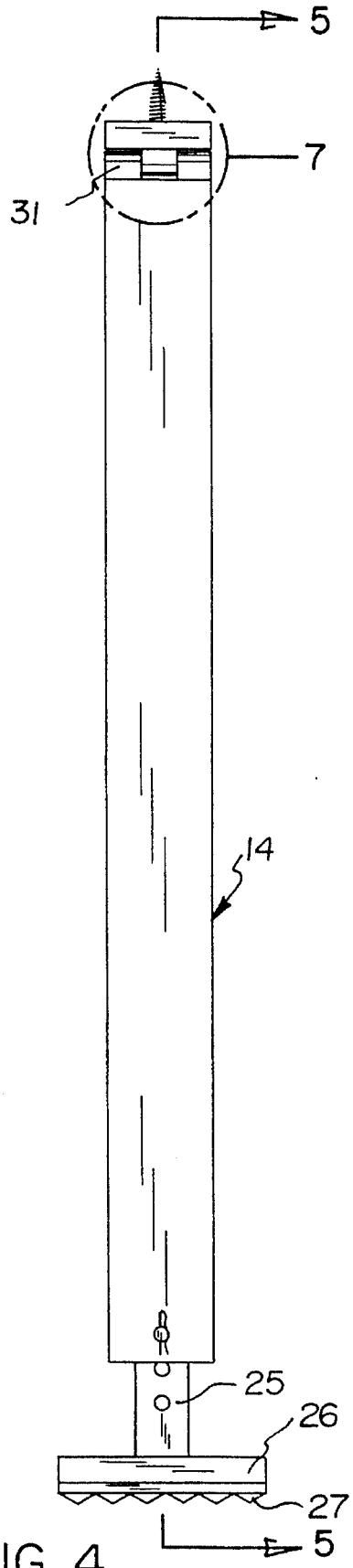
FIG. 4 is an orthographic elevational view of an exemplary support post.
Figure 7:
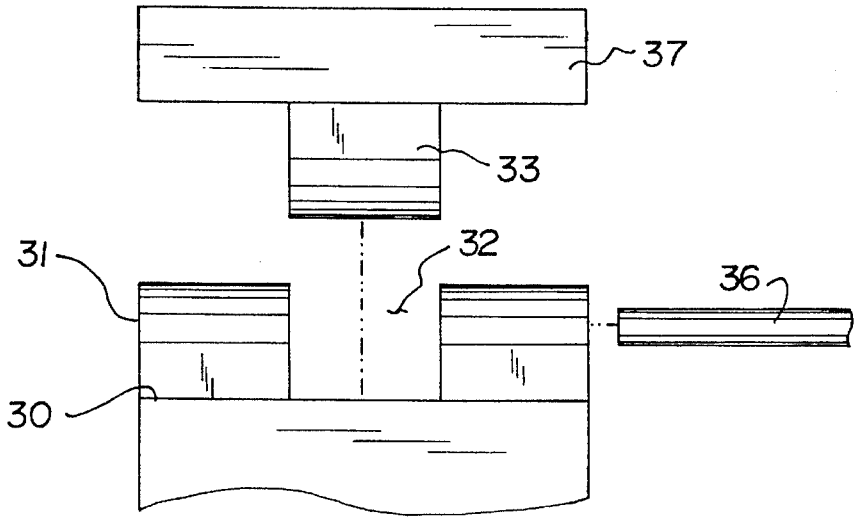
FIG. 7 is an enlarged orthographic view in exploded illustration of section 7 as illustrated in FIG. 4.

With reference to the FIGS. 4, 5, and 7, the support post second end 30 is fixedly secured to a support lug 31 defining a gap 32 within the support lug 31, wherein the gap 32 receives a pivot lug 33 that is pivotally mounted to the support lug 31 by a pivot axle 36. The pivot lug 33 in turn has fixedly secured thereto a securement plate 34. A plurality of fasteners 35 extend through the securement plate 34 into a bottom surface of the existing elongate rail member 11 to thereby secure the organization relative to the existing rail member 11.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. An adjustable handrail, comprising at least one support post, and at least one secondary rail member, wherein the secondary rail member is arranged for securement to the support post, the support post having spaced side walls, wherein one of said spaced side walls has a row of receiving slots, and the secondary rail member having secured thereto a mounting plate, the mounting plate including at least one projection arranged for reception within one of said slots, said secondary rail member including a bottom wall, said bottom wall having a support bracket and a support leg, the support leg having a first end spaced from a second end with the first end received within and secured to the bracket, the mounting plate having a front wall spaced from a rear wall, and the support leg second end fixedly secured to the front wall with the rear wall having said projection secured thereto, said projection being of an L-shaped configuration and wherein the slots are each of a generally L-shaped configuration complementarily arranged to receive said projection, and wherein the hand rail includes a lock fastener directed through the mounting plate in engagement with the support post.

2. An adjustable hand rail as set forth in claim 1 wherein the support post includes a support post first end spaced from a support post second end, the support post first end telescopingly receiving a telescoping leg therewithin, the telescoping leg having a row of leg bores, with a lock pin arranged for reception through one of said leg bores and simultaneously through the support post to secure the telescoping leg adjustably relative to the support post.

3. An adjustable hand rail as set forth in claim 2 wherein the telescoping leg further includes a support plate fixedly secured to the telescoping leg exteriorly of the support post, the support plate having a support plate bottom wall, and the support plate bottom wall including a resilient support pad fixedly secured thereto.

4. An adjustable hand rail as set forth in claim 3 wherein the support post second end includes a support lug, the support lug having a gap and a pivot lug, the pivot lug received pivotally within the gap, and a pivot axle directed through the support lug and the pivot lug pivotally mounting the pivot lug relative to the support lug, the pivot lug further having a securement plate fixedly secured to the pivot lug, with the securement plate spaced from the support post second end, and at least one securement plate fastener directed through the securement plate arranged for securing the securement plate to an existing elongate rail member.

* * * * *